US011297959B2

(12) United States Patent
Broun

(10) Patent No.: US 11,297,959 B2
(45) Date of Patent: Apr. 12, 2022

(54) DO-IT-YOURSELF AWARD DISPLAY AND STORAGE SYSTEM

(71) Applicant: Joseph Broun, Calcinato (IT)

(72) Inventor: Joseph Broun, Calcinato (IT)

( * ) Notice: Subject to any disclaimer, the term of this patent is extended or adjusted under 35 U.S.C. 154(b) by 12 days.

(21) Appl. No.: 16/907,500

(22) Filed: Jun. 22, 2020

(65) Prior Publication Data

US 2021/0393054 A1 Dec. 23, 2021

(51) Int. Cl.
*A47G 1/12* (2006.01)

(52) U.S. Cl.
CPC ..... *A47G 1/12* (2013.01)

(58) Field of Classification Search
CPC ..... A47G 1/12; A44C 3/008
See application file for complete search history.

(56) References Cited

U.S. PATENT DOCUMENTS 6,322,174 B1 * 11/2001 Palmqvist ..... A47F 3/001 312/114
6,793,297 B2 9/2004 Johnson et al.
6,817,129 B1 * 11/2004 Purdy ..... A47G 1/12 40/722
7,731,023 B1 * 6/2010 Lesch ..... A47G 1/12 206/6.1
8,464,450 B1 * 6/2013 Kendall ..... A47G 1/12 40/800
8,881,441 B2 11/2014 Thornton
D790,259 S * 6/2017 Rodriguez ..... D6/661
2009/0145804 A1 * 6/2009 Kabel ..... A47G 1/0616 206/783
2014/0212602 A1 * 7/2014 Thornton ..... A47G 1/12 428/14

OTHER PUBLICATIONS

Run Infinity, Product Review: Premium Medal Display Case, Posted on Jul. 5, 2016 http://runinfinity.com/2016/00/product-review-medal-display-case.html.

* cited by examiner

*Primary Examiner* — Gary C Hoge
(74) *Attorney, Agent, or Firm* — Saile Ackerman LLC; Stephen B. Ackerman; Rosemary L. S. Pike

(57) ABSTRACT

A do-it-yourself awards storage and display system is described. The system comprises a cassette having a hollow space therein configured to receive ribbons attached to awards within the hollow space and a cloth cover configured to wrap around the cassette and cover a front surface thereof and configured to display the awards on the cloth cover. The cloth-covered cassette can then be placed into a frame for display.

22 Claims, 14 Drawing Sheets

DO-IT-YOURSELF AWARD DISPLAY AND STORAGE SYSTEM

TECHNICAL FIELD

This application relates to the general field of display and storage systems, and more particularly, to a do-it-yourself display and storage system for awards and medals.

BACKGROUND

Millions of people each year take medals and awards home and place them in drawers or boxes, hang them from rods or hooks, or have them professionally mounted at very high expense. Currently there is not an ideal system for displaying and storing these medals for the center of this substantial overall market where medals can be added easily to a user-friendly system.

U.S. Pat. No. 8,881,441 (Thornton) is an example of a system for displaying medals, different from the present disclosure.

SUMMARY

It is an object of the present disclosure to provide a do-it-yourself system for displaying and storing awards.

It is a further object of the present disclosure to provide a do-it-yourself system for displaying and storing awards in which awards can be added and arranged easily and quickly, interactively and dynamically.

In accordance with the objectives of the present disclosure, a do-it-yourself awards storage and display system is achieved. The system comprises a cassette having a hollow space therein configured to receive ribbons attached to awards within the hollow space and a cloth cover configured to wrap around the cassette and cover a front surface thereof and configured to display the awards against the cloth cover. The cloth-covered cassette can then be placed into a frame for display.

Also in accordance with the objectives of the present disclosure, a method of using a do-it-yourself awards display and storage is achieved. The method comprises providing a cassette having a hollow space therein configured to receive ribbons attached to awards within the hollow space, placing the ribbons within the cassette and closing the cassette, and wrapping a cloth cover around the cassette covering a front surface thereof wherein the awards are displayed against the cloth cover.

BRIEF DESCRIPTION OF THE DRAWINGS

In the accompanying drawings forming a material part of this description, there is shown.

DETAILED DESCRIPTION

The present disclosure provides a system and method allowing do-it-yourself mounting of awards and medals for display and storage. The system is user-friendly and so easy to operate that children are able to add a medal to the system without supervision. Awards, medals, and any sort of three-dimensional (3D) object can be stored in the display case of the present disclosure.

The components of the display and storage system of the present disclosure include:

1) A cassette, like an empty book set on its binding, holds the ribbon(s) of the medal(s). The cassette has spacers lining the typically three open sides and these hold the medal(s) in place, 2) A cloth cover that wraps around the cassette keeping it closed and allowing for personalization, and 3) A frame that is wide enough to accommodate the cassette, the cloth cover, and the medals (or other 3D objects), which provides spacing between the frame's interior and the cassette.

Disclosed is a system for storage and display of awards or medals using book-like cassettes. In some embodiment, the system of cassettes sit one atop another within a track-like alignment mechanism which holds the cassettes closed firmly in position and allows medals to hang for display. The cassettes are bound closed with a cloth cover using a feature for closure such as Velcro, hooks, buttons, snaps, or the like.

In some embodiments, the system is reliant upon front and back spacers, which can be formed in various ways. The system is a modular system that uses compartments to hold safely in place and support the display of three dimensional objects such as medals, ribbons, pins, etc. The system can use magnets or mechanical closure features, and can be constructed in one of several embodiments including: 1) a book-like cassette, 2) a pouch within a box, 3) a magnetic fastening front panel to a base, or 4) a top-opening drawer.

In some embodiments, the system features compartments that open in various ways or frames made as necessary in order to accommodate them. Cassettes and/or frames can be manufactured using any one of or any combination of plastic, paper, wood, and metal and can be produced in any color or with any finish or superficial detail. Dimensions and the number of cassettes can be varied to make a frame for the display of, for example, five or more cassettes.

Figure 1A:
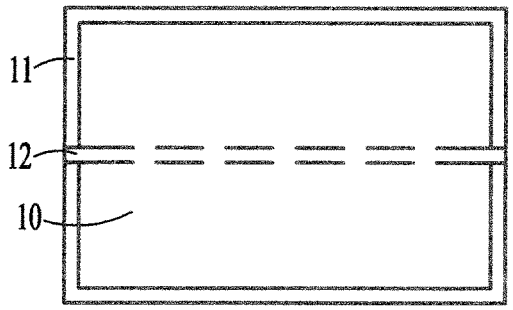
FIG. 1A illustrates an open view of a cassette in a first preferred embodiment of the present disclosure.
Figure 1B:
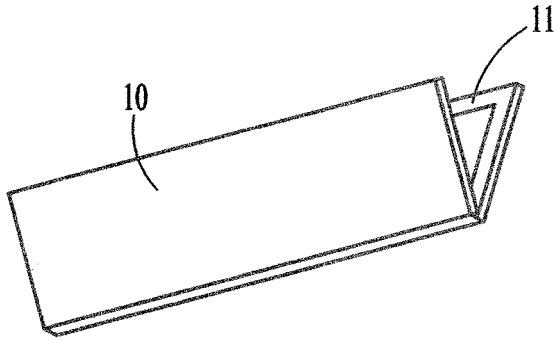
FIG. 1B illustrates a partially closed view of the cassette in FIG. 1A in the first preferred embodiment of the present disclosure.

The display and storage system of the present disclosure will be described in reference to the drawing figures. A first preferred embodiment will be described with reference to FIGS. 1-4. FIG. 1A illustrates an open view and FIG. 1B illustrates a partially closed view of a cassette of the present disclosure. The cassette 10 is shaped like an empty book set on its binding, as shown in FIG. 1B. The cassette may be manufactured of any one of, or any combination of, plastic, paper, wood, and metal. Preferably, spacers 11 on the inner edges of the cassette provide a hollow space for the ribbons attached to medals to be stored within the cassette. The spacers also offer a harmless surface that offers both cushioning and grip for the ribbons. The fold of the cassette is denoted by 12.

Figure 2:
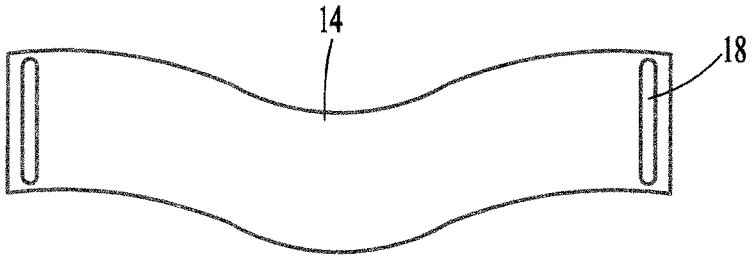
FIG. 2 illustrates a cassette covering in a first preferred embodiment of the present disclosure.

A cloth cover 14, illustrated in FIG. 2, wraps around the cassette keeping it closed and allowing for personalization. For example, the cover 14 may be fabricated in any of a variety of colors and patterns to personalize and set off the medals to be displayed.

Figure 3A:
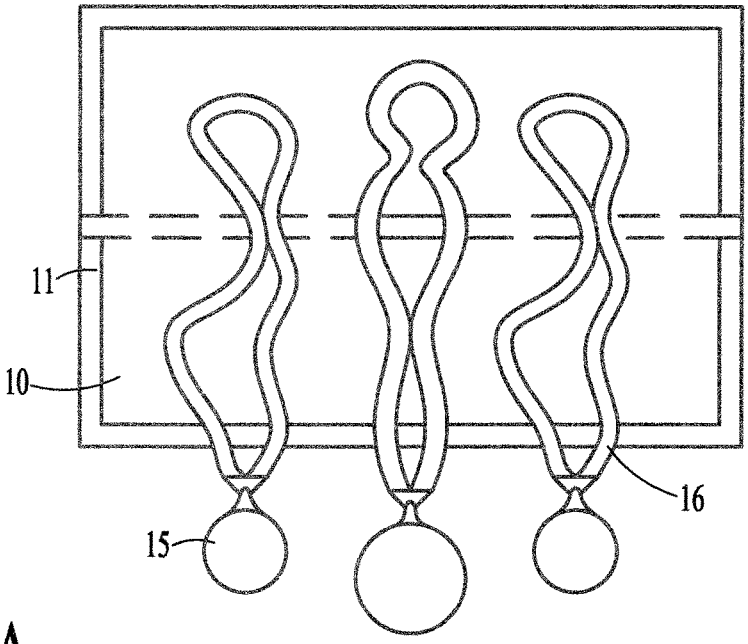
FIG. 3A illustrates a rear view of the open cassette in FIG. 1A where medals are placed into the cassette in a first preferred embodiment of the present disclosure.
Figure 3B:
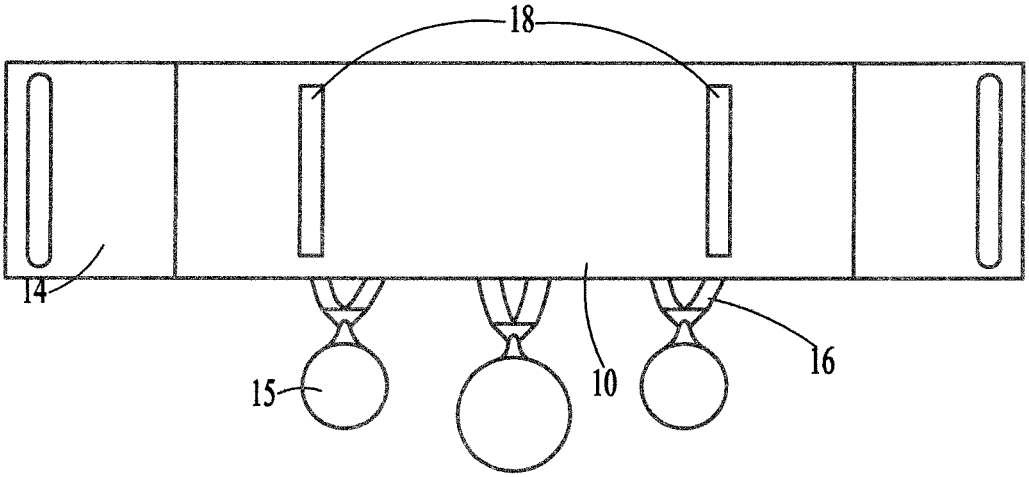
FIG. 3B illustrates a rear view of the closed cassette in FIG. 1B on the cover of FIG. 2 where medals are placed into the cassette in a first preferred embodiment of the present disclosure.
Figure 3C:
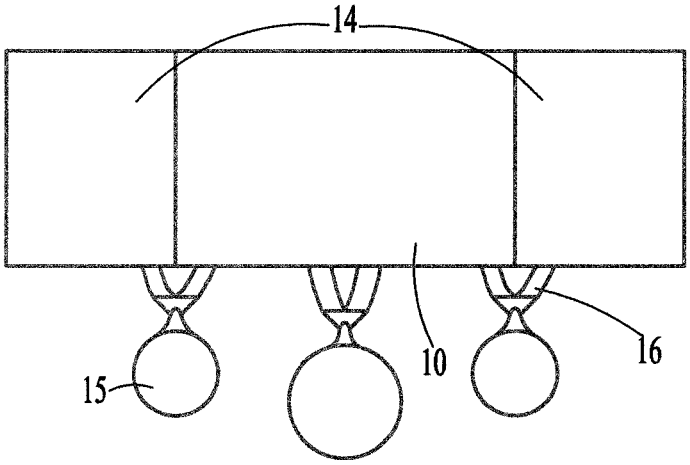
FIG. 3C illustrates a rear view of the closed cassette in FIG. 1B where the cover in FIG. 2 is attached to the cassette.
Figure 3D:
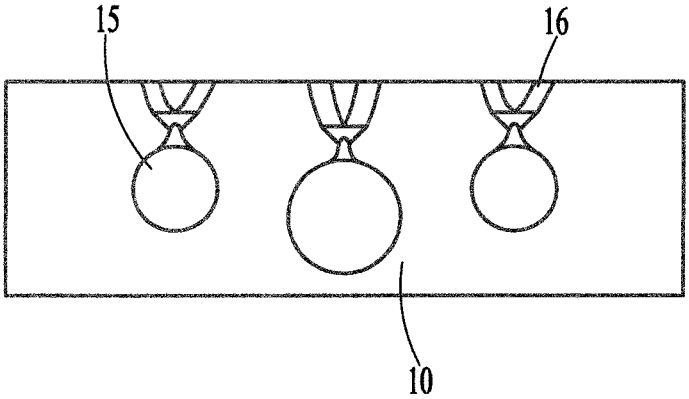
FIG. 3D illustrates a front view of the closed cassette in FIG. 3C.

To display and store medals using the system of the present disclosure, the user places the ribbons attached to the medals to be displayed within one side of the cassette. FIG. 3A illustrates a rear view of the open inside of the cassette 10. The ribbons 16 are placed inside the open area surrounded by the spacers 11. The spacers 11 can be foam, plastic, wood, or cardboard, for example. In FIG. 3B, the cassette has been closed, capturing the ribbons inside. To connect the cassette and cloth cover, the cassette is preferably laid on the cloth cover 14. In one way of connecting the fabric and cassette, hook and loop fastening such as Velco® 18 is on the rear surface of the cassette. As shown in FIG. 3C, the cloth cover 14 is attached to the cassette 10 with matching hook and loop fastening 18, for example, for a tight fit, holding the cassette closed. FIG. 3D illustrates the front view of the closed cassette 10 showing the medals 15 and portions of the ribbons 16. The medals are in position to be displayed.

Other means to fasten the cloth cover to the cassette to hold it closed can be used such as hooks, buttons, snaps, ties, or any of a variety of similar means, so long as the cover can be tightly held around the cassette.

Figure 4A:
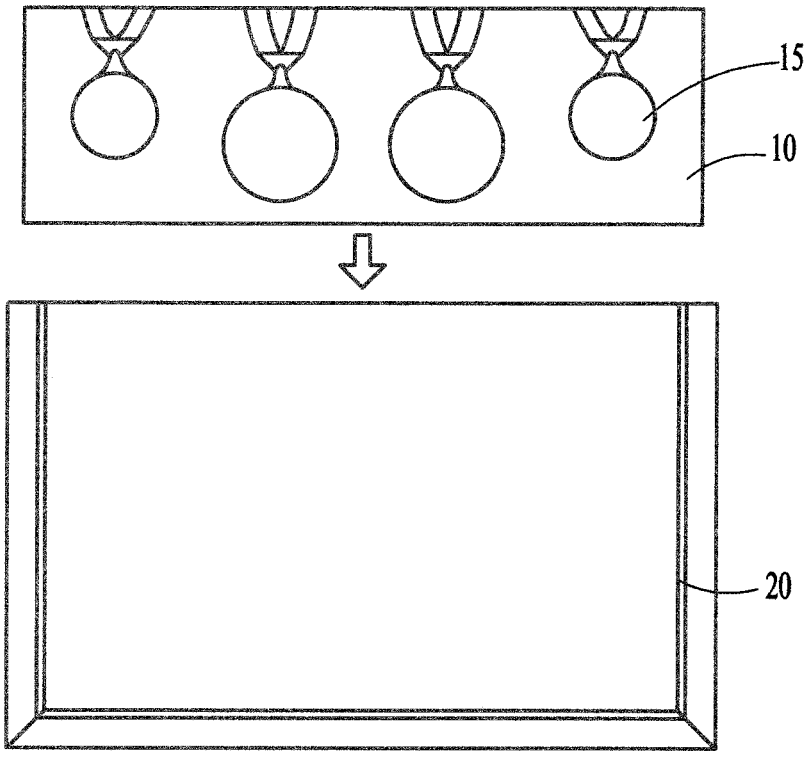
FIG. 4A illustrates the closed cassette in FIG. 3D and a tray assembly in a first preferred embodiment of the present disclosure.
Figure 4B:
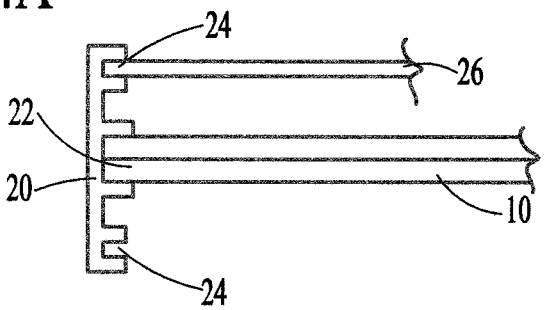
FIG. 4B illustrates an enlarged top view of a cassette within the tray assembly.

FIG. 4A illustrates a completed cassette 10 holding medals 15 and a tray assembly 20. FIG. 4B illustrates a cross section of a portion of the top right edge of the tray assembly 20. U-shaped side channel 22 is configured to receive a completed cassette. Channels 24 on either side of the central channel 22 are configured to receive a pane of glass, for example. The tray assembly 20 provides space for displaying the three-dimensional medals or other objects between the cassette 10 and the pane of glass, for example.

Figure 4C:
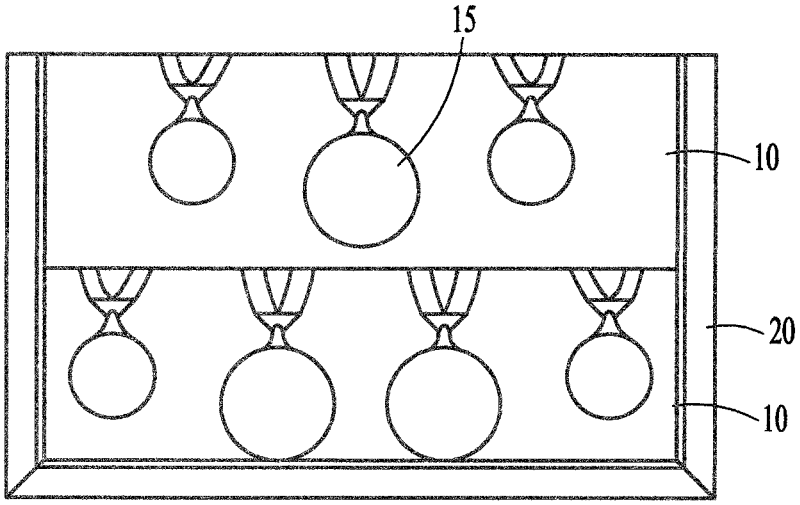
FIG. 4C illustrates cassettes in a tray assembly in a first preferred embodiment of the present disclosure.

The tray assembly 20 illustrated in FIG. 4A can hold two completed cassettes, one on top of the other, as shown in FIG. 4C. It will be understood by those skilled in the art that a tray assembly can be designed instead to hold only one completed cassette or to hold more than two completed cassettes. The tray assembly 20 could now be used as a completed display case as shown in FIG. 4C.

Figure 4D:
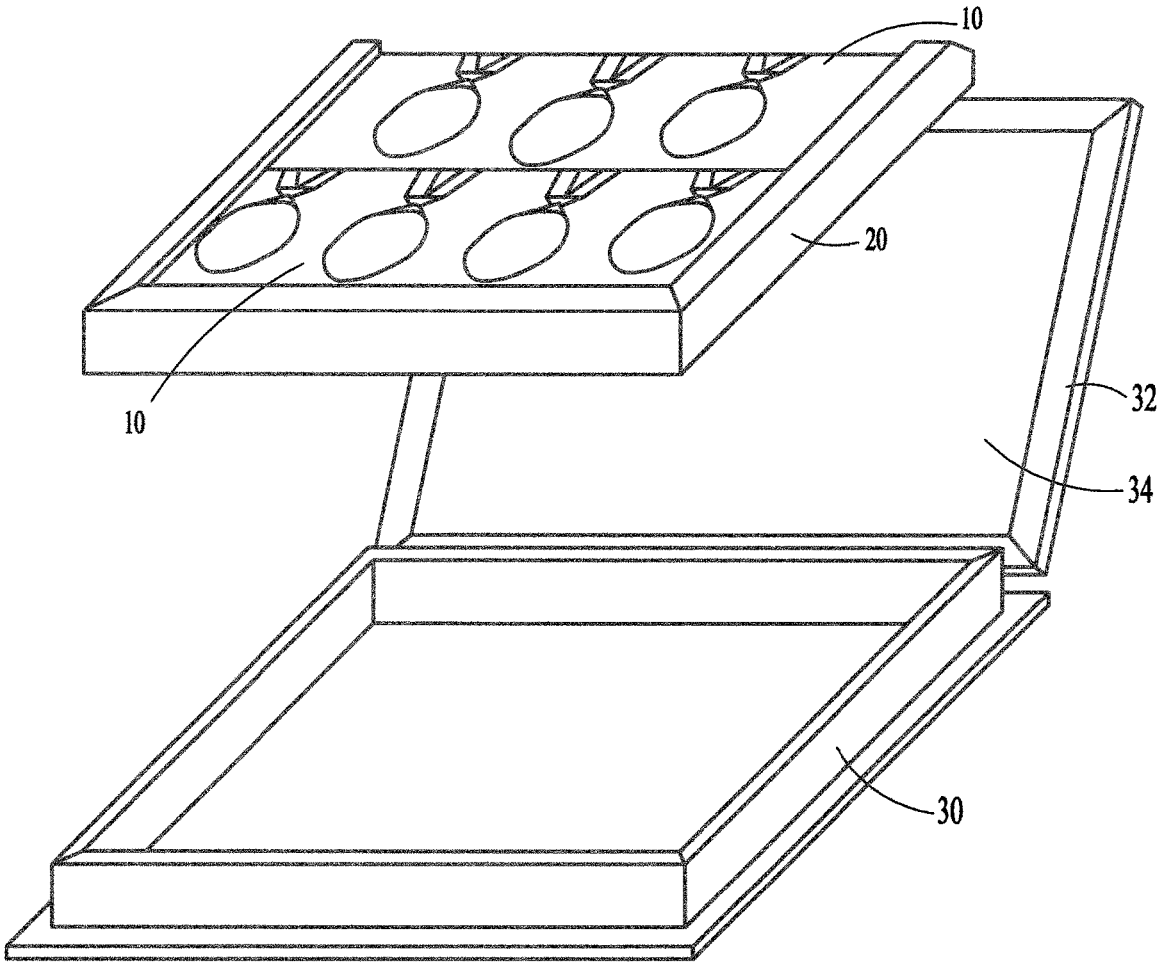
FIG. 4D illustrates the completed tray assembly in FIG. 4C and a frame in a first preferred embodiment of the present disclosure.
Figure 4E:
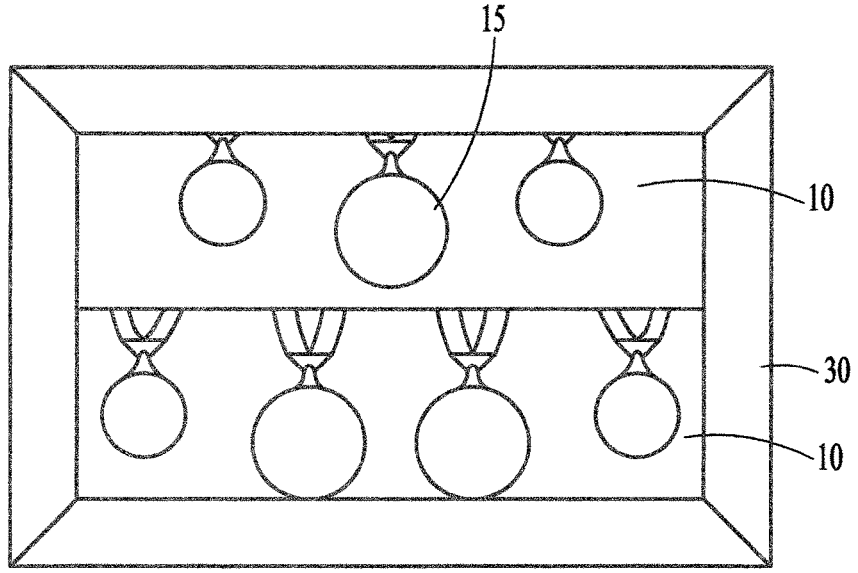
FIG. 4E illustrates a completed display system in a first preferred embodiment of the present disclosure.

Alternatively, as shown in FIG. 4D, the tray assembly 20 holding one or more completed cassettes 10 can be placed into a frame 30 which preferably can be closed with, for example, a lid 32 having a substantial portion thereof a transparent pane 34, such as, for example, glass or acrylic. The frame 30 can then be hung on the wall, for example, to display the medals 15, as shown in FIG. 4E. The frame 40 may have hinges, locks, latches, or various other mechanisms to ensure closure. There could also be an handle and perhaps internal lighting. The frame may provide a shadow box for holding the cassettes allowing display or medals or other three-dimensional objects.

Figure 5A:
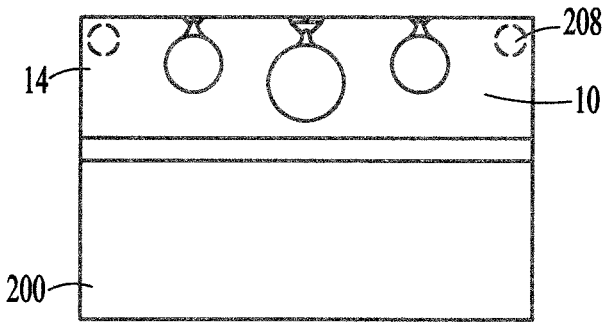
FIGS. 5A and 5B illustrate front and side views, respectively, of an alternative tray assembly in the first preferred embodiment of the present disclosure.
Figure 5B:
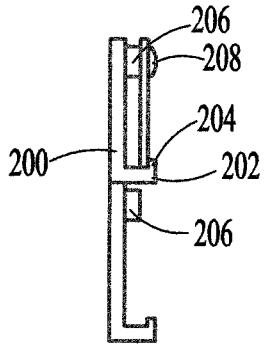

An alternative to tray assembly 20 is illustrated in FIGS. 5A and 5B. The tray assembly 200 illustrated is designed to hold two closed cassettes. It will be understood that tray assembly 200 can be designed to hold only one cassette or more than two cassettes. As can be seen in the side view in FIG. 5B, a shelf 202 with a lip 204 is configured so that the lower edge of closed cassette 10 rests on shelf 202 and is held in place by lip 204. The lip also acts as a spacer for displaying the three-dimensional medals 15. FIG. 5A shows magnets 208 at the corners of the upper edge of the cassette 10 underneath cloth cover 14. Magnets 208 interact with magnets or metal dots or points 206 on the corners of the tray assembly 200 to hold the upper edge of the cassette to the tray assembly 200. Now, the completed cassettes on the tray assembly 200 can be placed into frame 30 as shown in FIG. 4D.

Figure 6A:
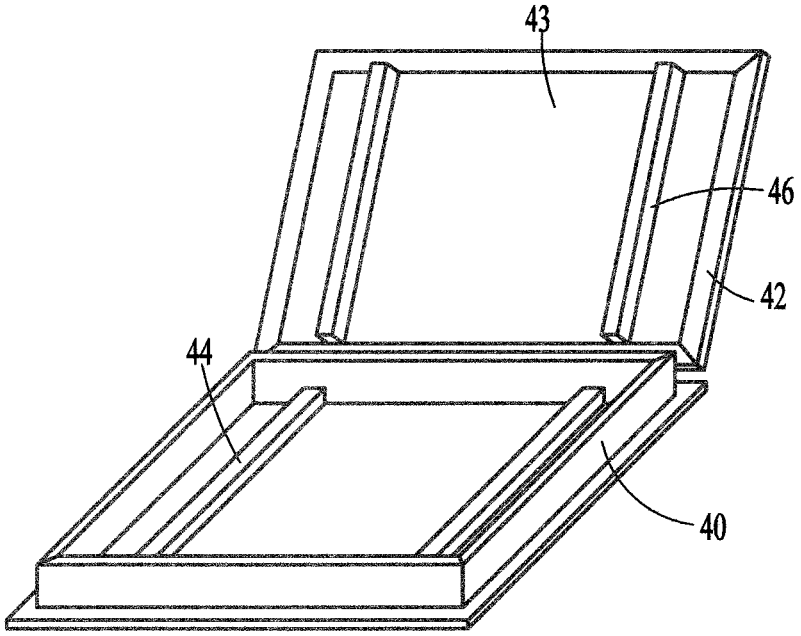
FIG. 6A illustrates the closed cassette in FIG. 3D and a frame in a second preferred embodiment of the present disclosure.

A second preferred embodiment of the present disclosure will be described with reference to FIGS. 1A, 1B, 2, 3D, 6A, and 6B. In this embodiment, medals 15 are placed into the cassette 10 as described in the first embodiment. Cover 14 is fastened around the closed cassette to hold the medals tightly therein, as shown in FIG. 3D. In this embodiment, a tray assembly is not used. Rather, as illustrated in FIG. 6A, frame 40 has spacers 44 attached on the base inside the frame. Spacers 46 are attached inside the upper lid 42 of the frame. For example, the spacers 44 and 46 can be made of foam and each be, preferably, about 10 mm thick.

One or more completed cassettes 10 may be placed inside the frame 40 on the spacers 44. When the lid 42 is closed, spacers 46 hold the completed cassettes snugly in the frame. If the cassette has a thickness of, for example, about 15 mm, a total depth inside the frame with the lid closed would be, preferably, about 10+15+10=35 mm.

Figure 6B:
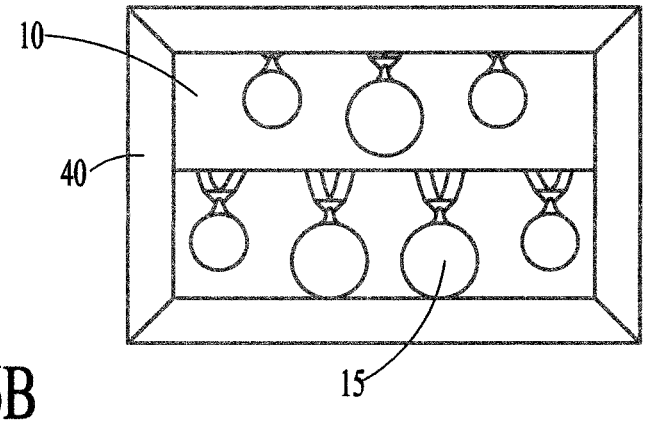
FIG. 6B illustrates a completed display system in the second preferred embodiment of the present disclosure.
Figure 6C:
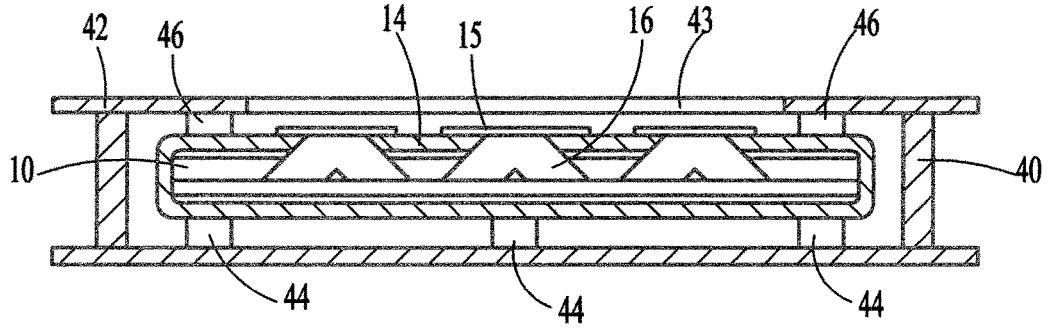
FIG. 6C is a cross-sectional illustration of a completed display system in the second preferred embodiment of the present disclosure.

The frame 40 can then be hung on a wall, as shown in FIG. 6B. FIG. 6C illustrates a cross-sectional view of FIG. 6B. Cloth 14 covered cassette 10 is shown inside the frame 40. In this example, there are preferably three spacers 44 inside the base of the frame 40 and two spacers 46 inside the lid 42. Preferably the lid comprises a clear, for example, glass or acrylic, panel 43. The spacers hold the cassette within the frame and allow space for the medals 15 or other three-dimensional items between the cassette and the inside of the lid 42.

Figure 7A:
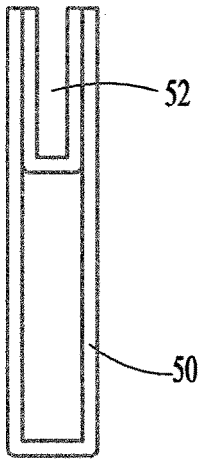
FIG. 7A illustrates an end view of a cassette in a third preferred embodiment of the present disclosure.
Figure 7B:
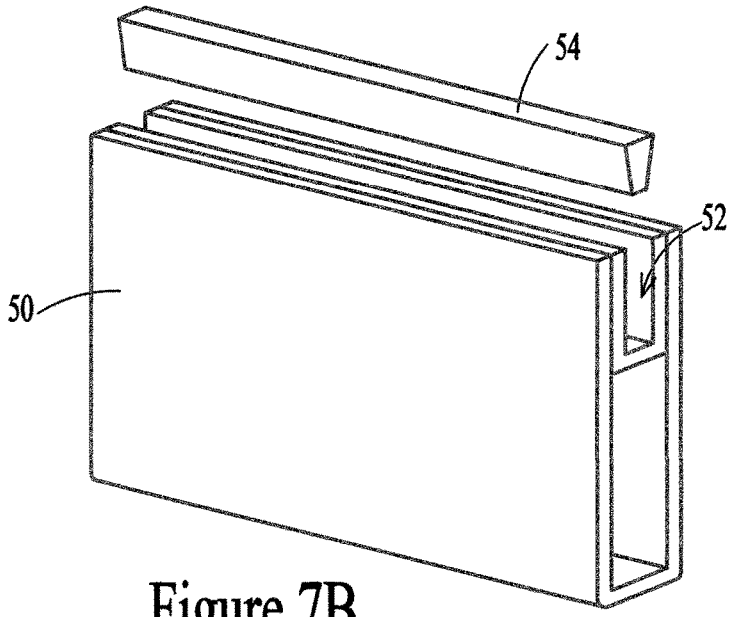
FIG. 7B illustrates a side view of the cassette in FIG. 7A in the third preferred embodiment of the present disclosure.

A third embodiment, illustrated in FIGS. 7A, 7B, 8A, and 8B uses a different kind of cassette. FIG. 7A shows an edge view and FIG. 7B shows a side view of the cassette 50. Cassette 50 has a U-shape and is open on three sides. Alternatively, the cassette 50 could be open only on the top side. A U-shaped channel 52 resides in the long open side of the cassette, opposite to the closed side, having top edges concurrent with the cassette. The U-shaped channel 50 will hold the ribbons of medals. Preferably wedge-shaped block 54 is shown.

Figure 8A:
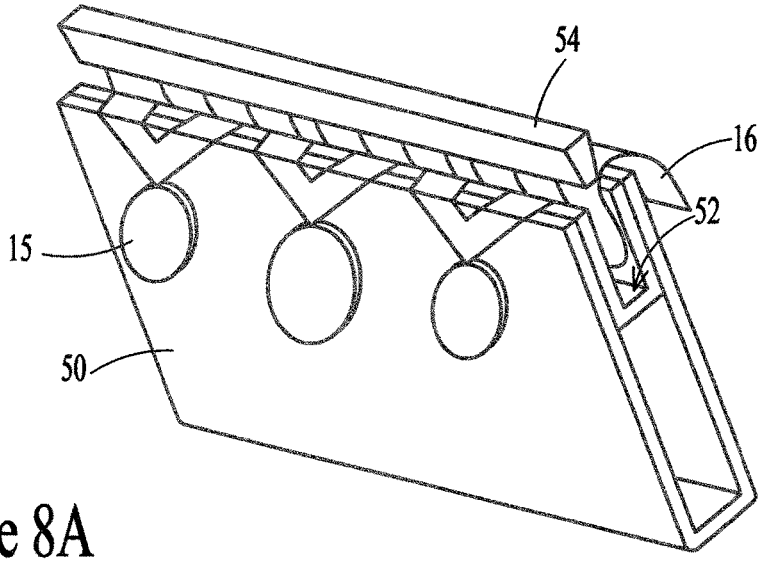
FIG. 8A illustrates an oblique view of the cassette in FIGS. 7A and 7B where medals are placed into the cassette in the third preferred embodiment of the present disclosure.
Figure 8B:
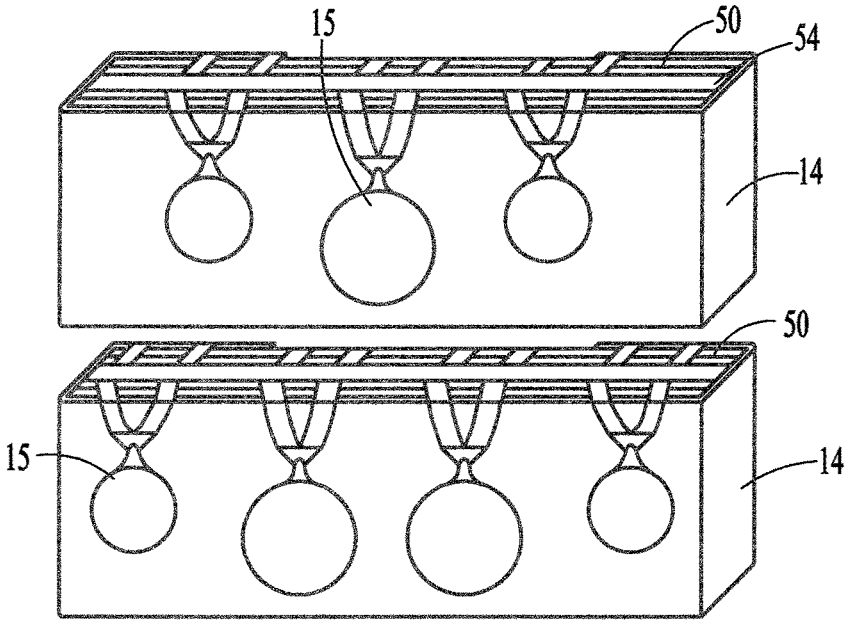
FIG. 8B illustrates a top view of the cassette in FIG. 8A in the third preferred embodiment of the present disclosure.

As illustrated in FIG. 8A, the ribbons 16 of medals 15 are placed over the U-shaped channel 52. Block 54 is inserted into the channel holding the ribbons snugly in place. The remainder of the ribbons fall over the rear surface of the cassette. Now, cover 14 is tightened around the cassette. FIG. 8B illustrates two completed cassettes 50.

Now, one of more of the completed cassettes 50 can be placed in the frame 40 as shown in FIG. 6A and hung as shown in FIG. 6B. Here, spacers 44 and 46 provide space for three-dimensional objects. Alternatively, one or more completed cassettes 50 may be placed in tray assembly 20 as shown in FIG. 4C, then placed in frame 30 as shown in FIG. 4D, and hung as shown in FIG. 4E. In this embodiment, the tray assembly provides spacing for displaying the three-dimensional objects.

Figure 9A:
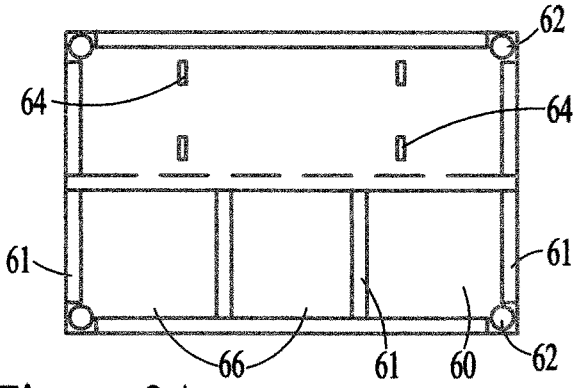
FIG. 9A illustrates an open view of a cassette in a fourth preferred embodiment of the present disclosure.
Figure 9B:
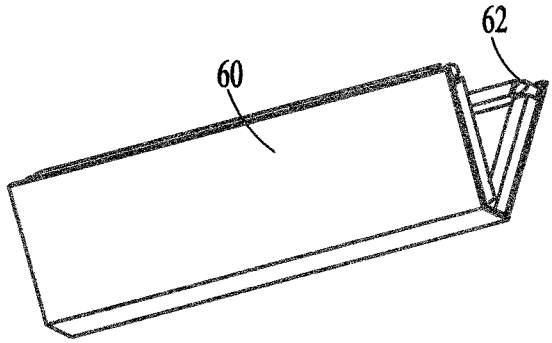
FIG. 9B illustrates a closed view of the cassette in FIG. 9A in the fourth preferred embodiment of the present disclosure.

A fourth embodiment uses another alternative type of cassette. FIG. 9A illustrates an open cassette 60 and FIG. 9B illustrates a partially closed cassette 60. Magnets 62 attached on the four inside corners of cassette 60 hold the cassette closed. Alternatively, mechanical closure mechanisms such as snaps or hook and loop tape could be used in place of the magnets to hold the cassette closed. Cassette 60 or the previously described cassette 10 can have compartments 66 on one half of the cassette. The compartments 66 provide areas for medal ribbons to be stored. Spacers 61 may be attached on the inside edges of the cassette. One or more slots 64 may be formed along the rear half of the cassette 64.

Figure 10A:
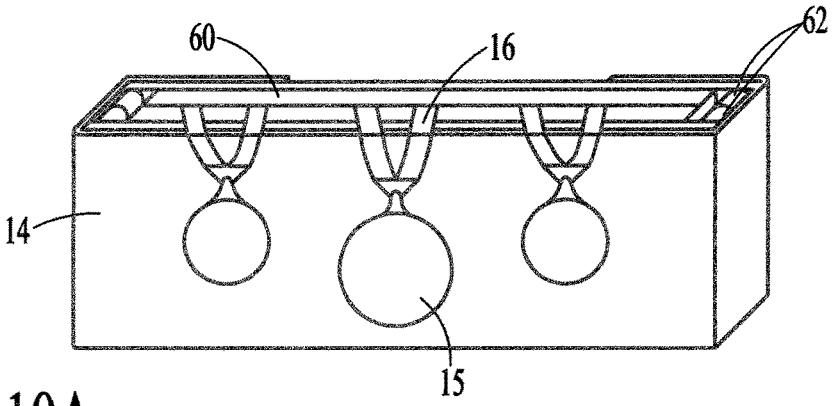
FIG. 10A illustrates a closed view of the cassette in FIGS. 9A and 9B where medals are placed into the cassette in the fourth preferred embodiment of the present disclosure.

To display and store medals using the system of the present disclosure, the user places the ribbons attached to the medals to be displayed within one side of the cassette. FIG. 9A illustrates a rear view of the open inside of the cassette 60. The ribbons 16 are placed inside the compartments 66 or inside the open area surrounded by the spacers 61. For example, the spacers 61 can be foam, plastic, wood, paper, or cardboard. The cassette is closed with the magnets 62, capturing the ribbons inside, as shown in FIG. 9B. The cassette is laid on the cloth cover 14, illustrated in FIG. 2. The cloth cover 14 is attached to the cassette 60 with hook and loop fastening, buttons, snaps, hooks, or the like, for a tight fit. FIG. 10A illustrates a completed cassette 60.

Figure 10B:
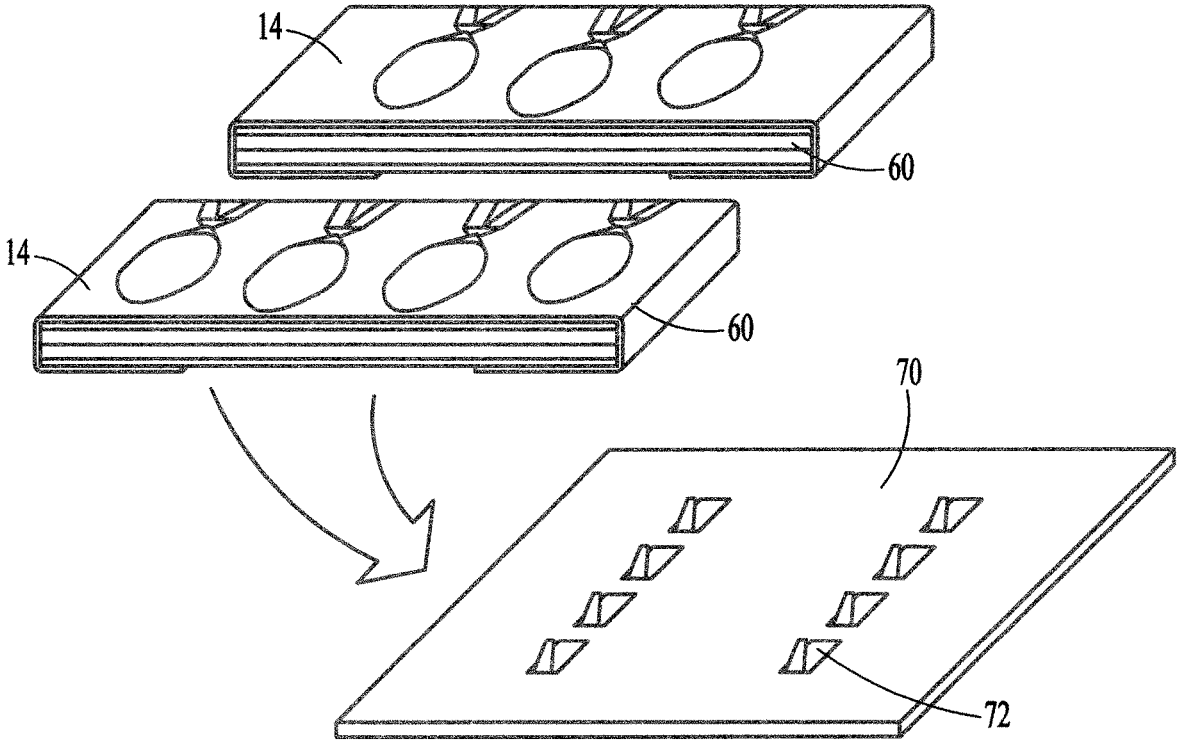
FIG. 10B illustrates a rear support panel in the fourth preferred embodiment of the present disclosure.
Figure 10C:
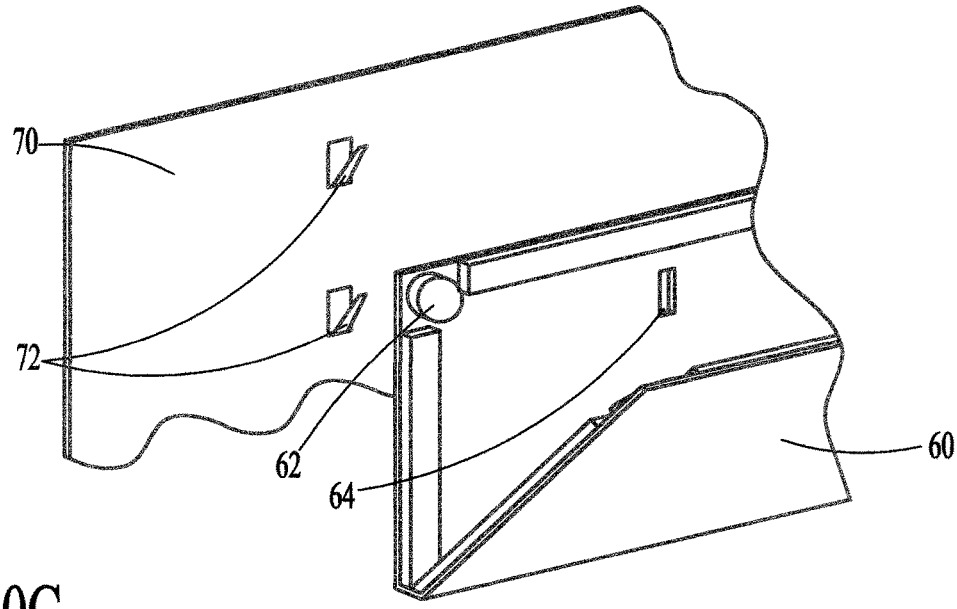
FIG. 10C illustrates a partially open view of the cassette in FIG. 10A showing how the cassette is attached to the rear support panel in FIG. 10B.

FIG. 10B illustrates a rear support panel 70. The panel has peg hooks 72, for example, in two rows on the panel. As shown in FIG. 10C, hooks 72 lock into slots 64 in the rear of the completed cassette 60. The slots and mating pegs will be located so that they do not interfere with the cloth cover 14. The rear support panel 70 shown in FIG. 10B can receive two completed cassettes 60, one above the other. It will be understood that a rear support panel 70 can be configured to receive only one completed cassette or more than two completed cassettes in any orientation.

Figure 10D:
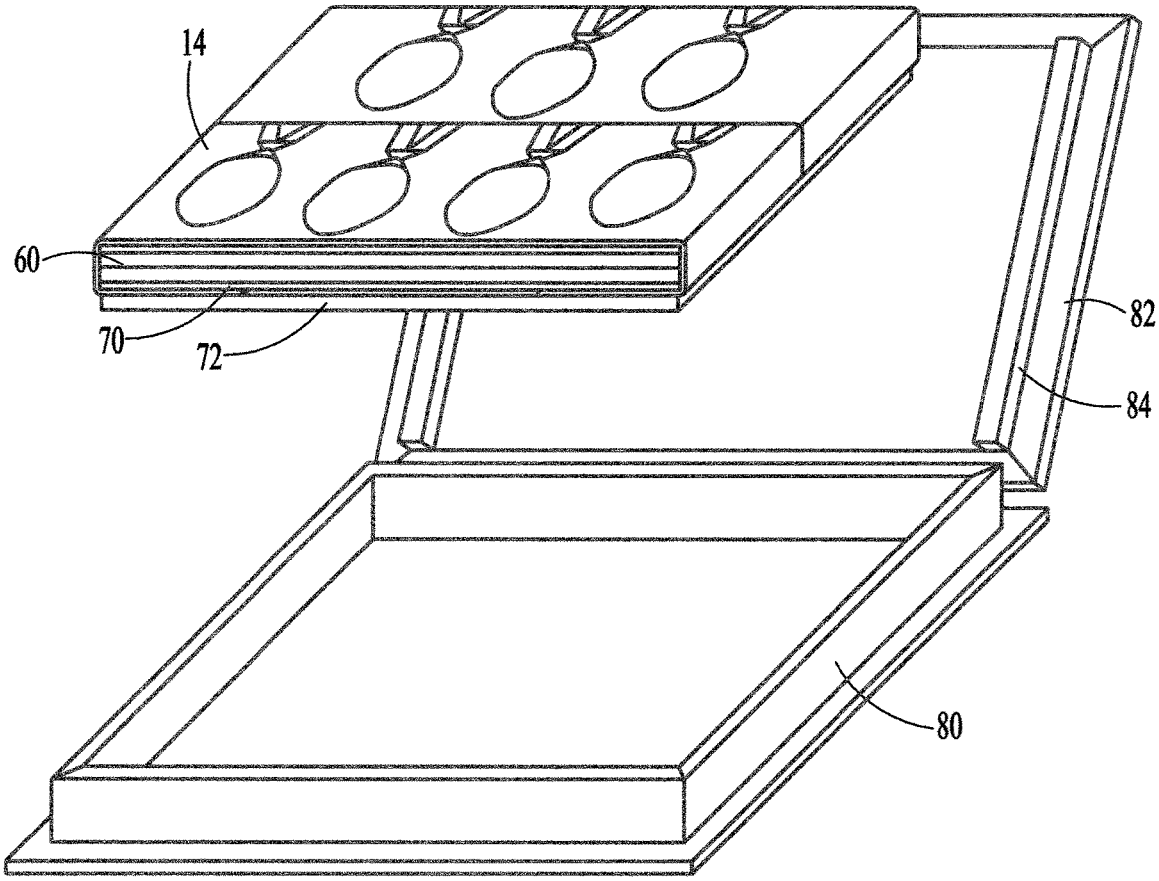
FIG. 10D illustrates the cassette in FIG. 10A mounted on the rear support panel in FIG. 10B and a frame in the fourth preferred embodiment of the present disclosure.
Figure 10E:
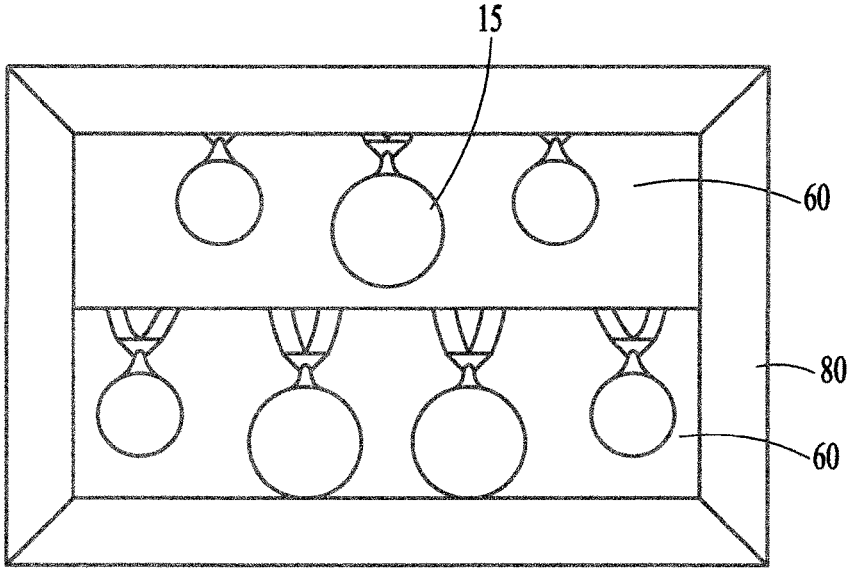
FIG. 10E illustrates a completed display system in the fourth preferred embodiment of the present disclosure.

Now, the rear support panel 70 having completed cassettes 60 attached thereon can be placed into a frame 80, illustrated in FIG. 10D. Preferably, spacers 84 are attached to a framed glass lid 82. When the lid 82 is closed, spacers 84 hold the support panel motionless in the frame, providing space for displaying three-dimensional objects 15. The frame may be hung to display the medals 15 as shown in FIG. 10E.

Figure 11A:
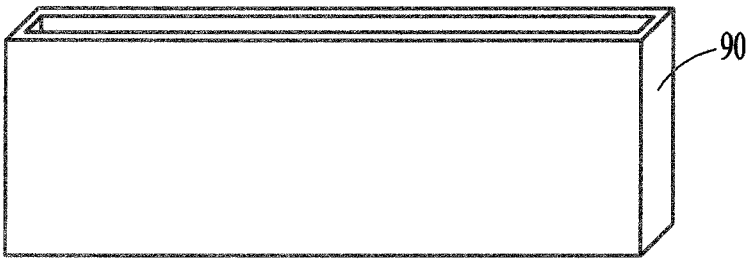
FIG. 11A illustrates a cassette in a fifth preferred embodiment of the present disclosure.
Figure 11B:
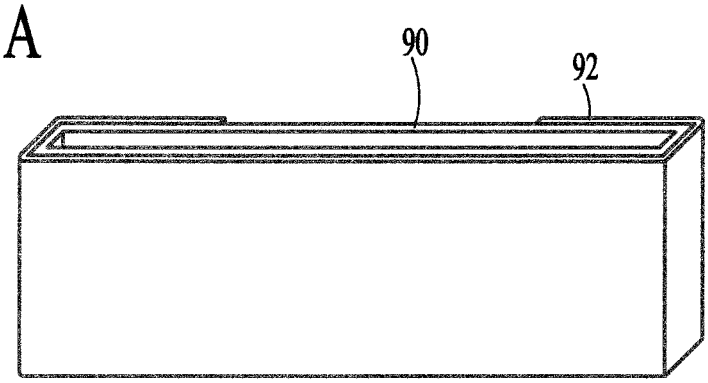
FIG. 11B illustrates the cassette in FIG. 11A covered with the cassette covering in FIG. 12 in the fifth preferred embodiment of the present disclosure.
Figure 11C:
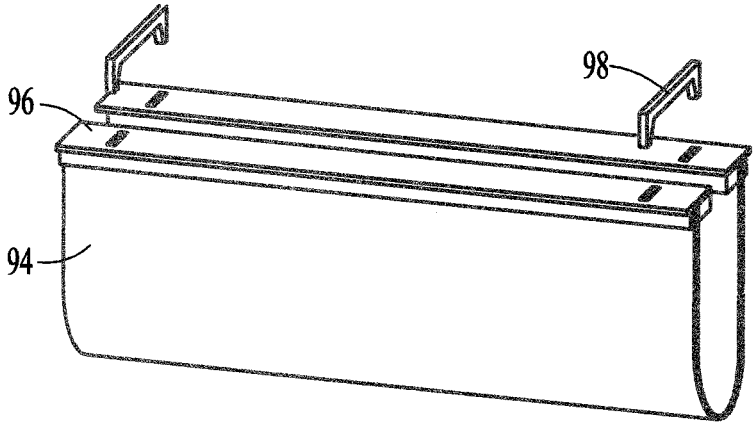
FIG. 11C illustrates a pouch in a fifth preferred embodiment of the present disclosure.
Figure 12:
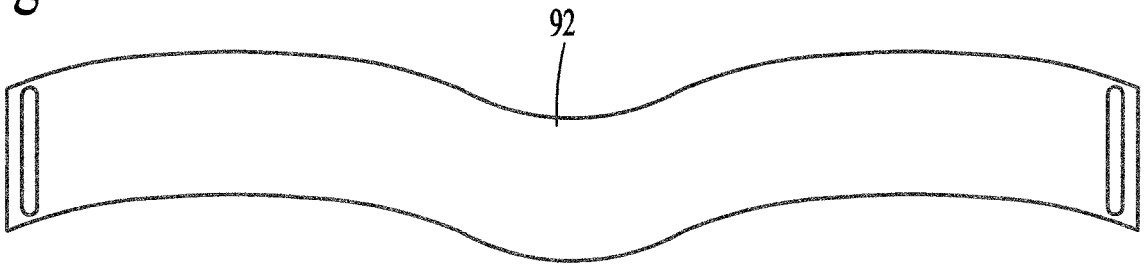
FIG. 12 illustrates a cassette covering in the fifth preferred embodiment of the present disclosure.

A fifth embodiment of the present disclosure uses another alternative cassette 90. FIG. 11A shows cassette 90 which is a hollow box open at one long end. FIG. 12 shows cloth cover 92. The cloth cover 92 is wrapped around the front surface of cassette 90 and fastened by hook and loop, snaps, buttons, ties, or the like. In this embodiment, the cover serves as personalization only. FIG. 11C shows a foldable pouch 94 which holds the ribbons 16 of medals 15. Brackets on the top long edges of the pouch meet when the pouch is folded in half to hold the ribbons between them. Preferably, and for example, U-shaped locking pins 98 fit into holes on either end of the brackets locking them together to hold the pouch closed.

Figure 13A:
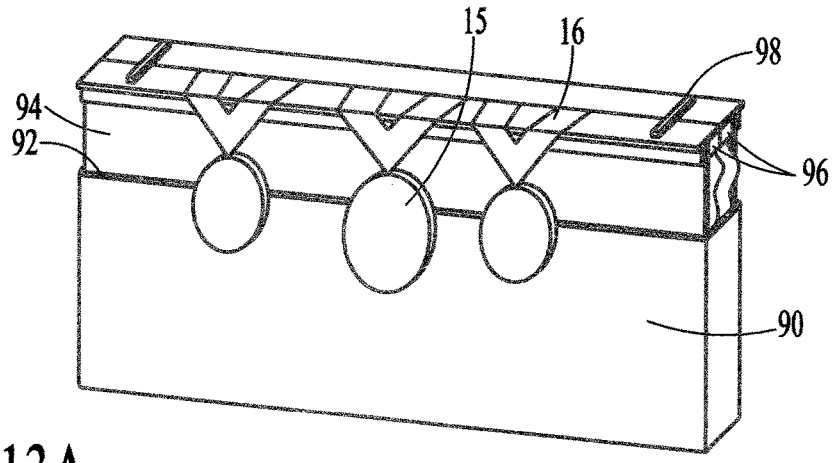
FIG. 13A illustrates the pouch in FIG. 11C and the cassette in FIG. 11B where medals are placed into the pouch and the pouch is placed into the cassette in the fifth preferred embodiment of the present disclosure.
Figure 13B:
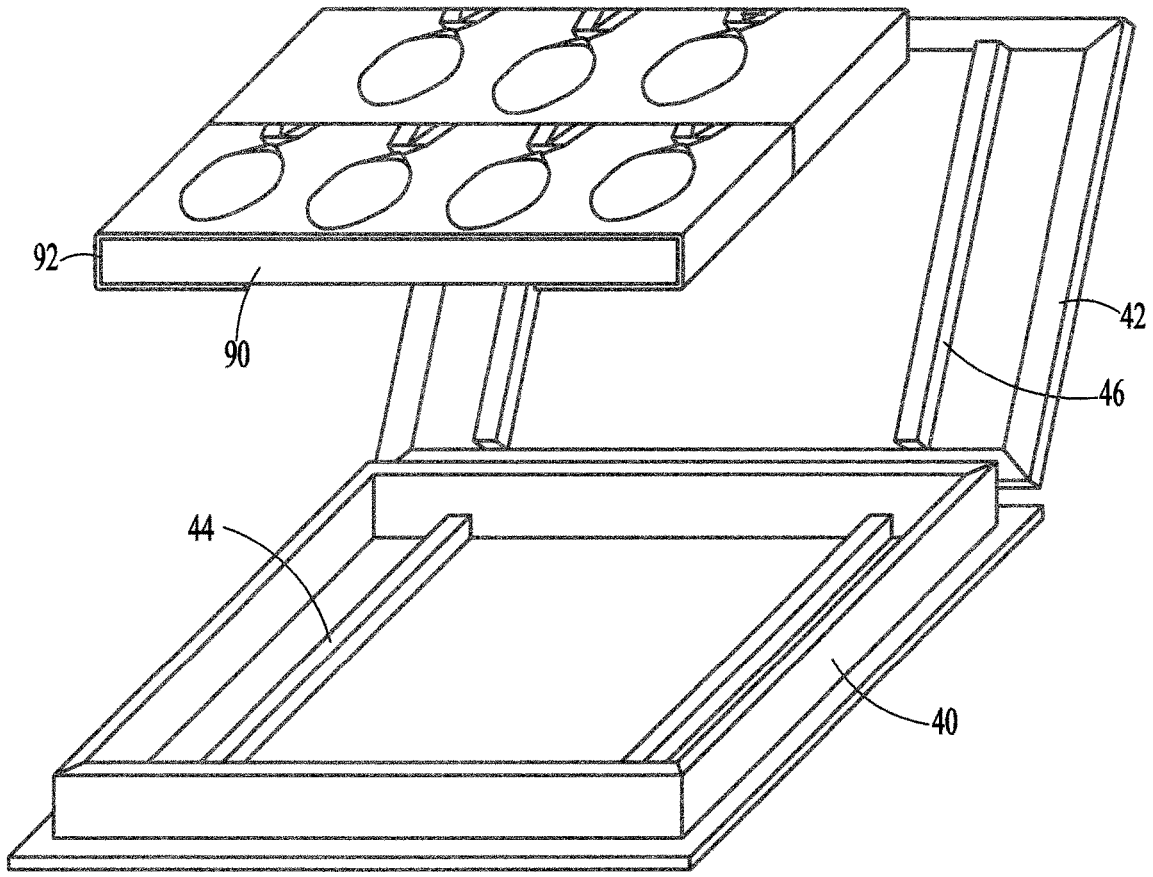
FIG. 13B illustrates the cassette in FIG. 13A and a frame in the fifth preferred embodiment of the present disclosure.
Figure 13C:
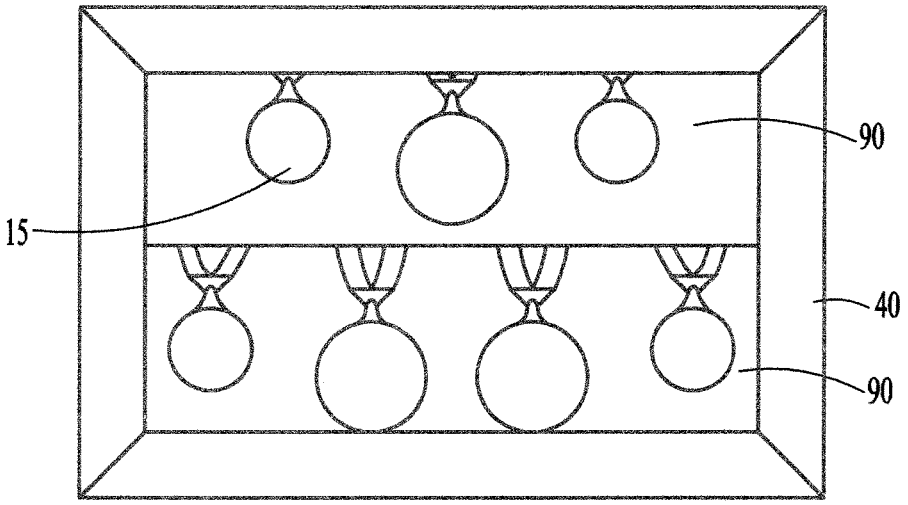
FIG. 13C illustrates a completed display system in the fifth preferred embodiment of the present disclosure.

Next, as shown in FIG. 13A, the closed pouch 94 is slid into the cassette 90. The medals 15 lie on the outside of the cassette 90. Now, one or more completed cassettes 90 can be placed into a frame 40, illustrated in FIG. 13B. Preferably, spacers 44 are in the bottom of the frame and spacers 46 are attached to a framed glass lid 42. The cassettes rest on the spacers 44. When the lid 42 is closed, spacers 46 and 44 together provide space for displaying the three-dimensional objects and hold the cassettes in the frame. The frame may be hung to display the medals 15 as shown in FIG. 13C.

Figure 14A:
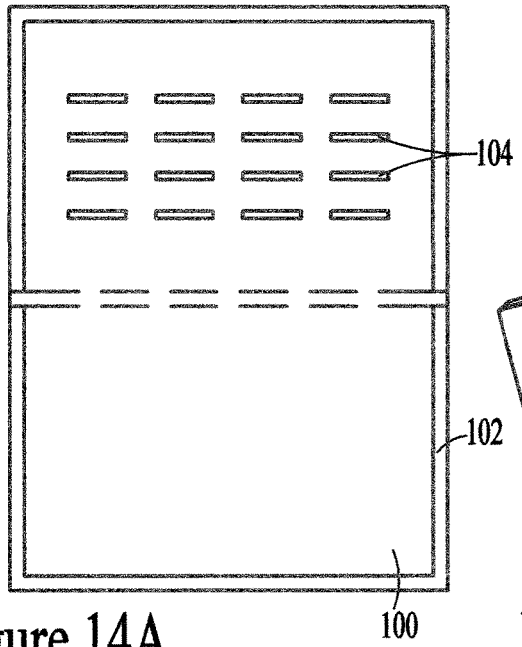
FIG. 14A illustrates a open view of a cassette in a sixth preferred embodiment of the present disclosure.
Figure 14B:
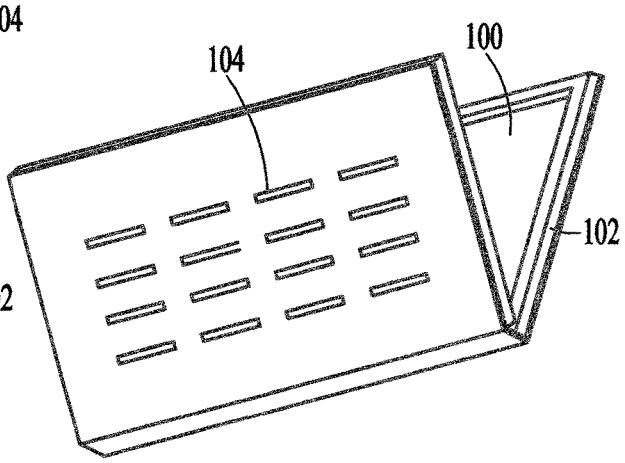
FIG. 14B illustrates a partially closed view of the cassette in FIG. 14A in a sixth preferred embodiment of the present disclosure.
Figure 15:
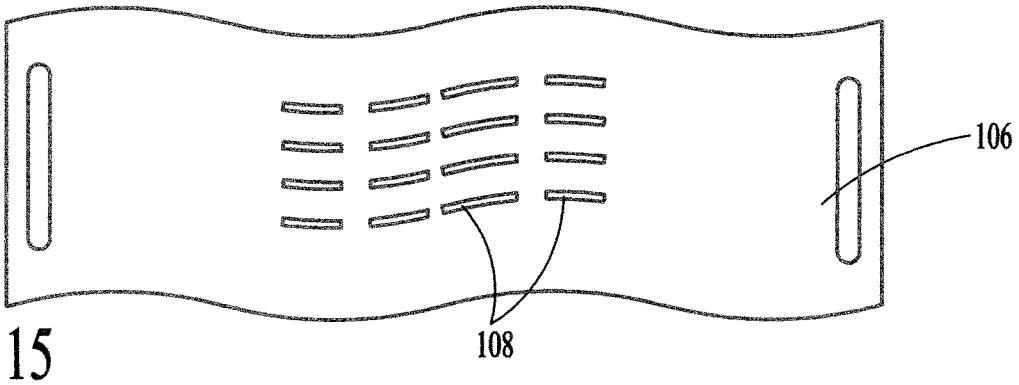
FIG. 15 illustrates a cassette covering in the sixth preferred embodiment of the present disclosure.

A sixth embodiment of the present disclosure uses yet another alternative cassette 100. FIG. 14A shows open cassette 100 having spacers 102 around all edges of the cassette. The front surface of the cassette has slots 104 preferably arranged in rows and columns. FIG. 14B shows a partially closed view of the cassette 100. FIG. 15 shows cloth cover 106 sized to fit over the front surface and part of the rear surface of the cassette 100. Slits 108 in the cloth correspond to the slots 104 in the front surface of the cassette.

Figure 16A:
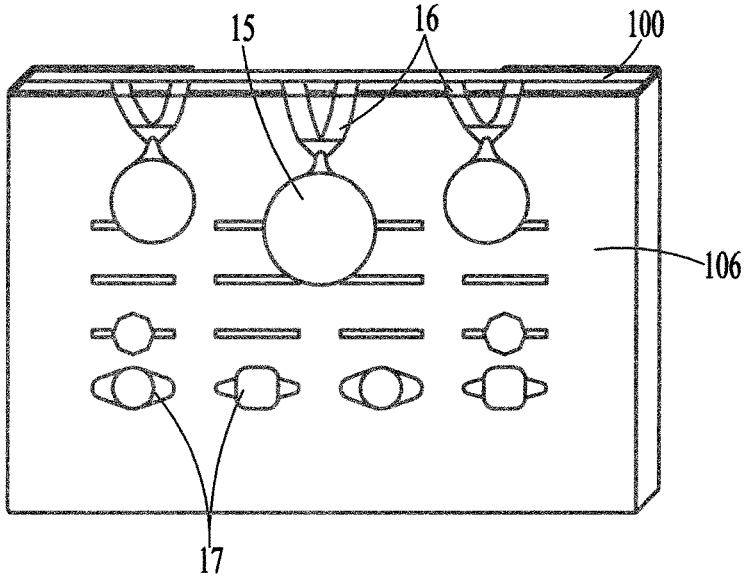
FIG. 16A illustrates the cassette in FIGS. 14A and 14B covered with the cassette covering in FIG. 15 where medals are placed into the cassette in the sixth preferred embodiment of the present disclosure.

As in other embodiments, the ribbons 16 of medals 15 are placed within the interior of the cassette 100, as shown in FIG. 16A. Next, the cloth cover 106 is wrapped around the front surface of cassette 100 and fastened by hook and loop, snaps, buttons, ties, or the like to hold the cassette closed. Then, other items, such as, for example, championship rings 17, can be inserted into slits 108. These slits could also be used to hold other items having different shapes such as pins or medals without ribbons.

In any of the embodiments, one could easily attach any items to the cloth cover using a straight pin, safety pin, or any kind of built-in pin such as on a lapel pin, election button, runner's bib with safety pin, and so on. Additionally, the cloth could be customized with a personalized print, or a repurposed jersey, for example, and items could even be sewn onto the cloth cover.

Figure 16B:
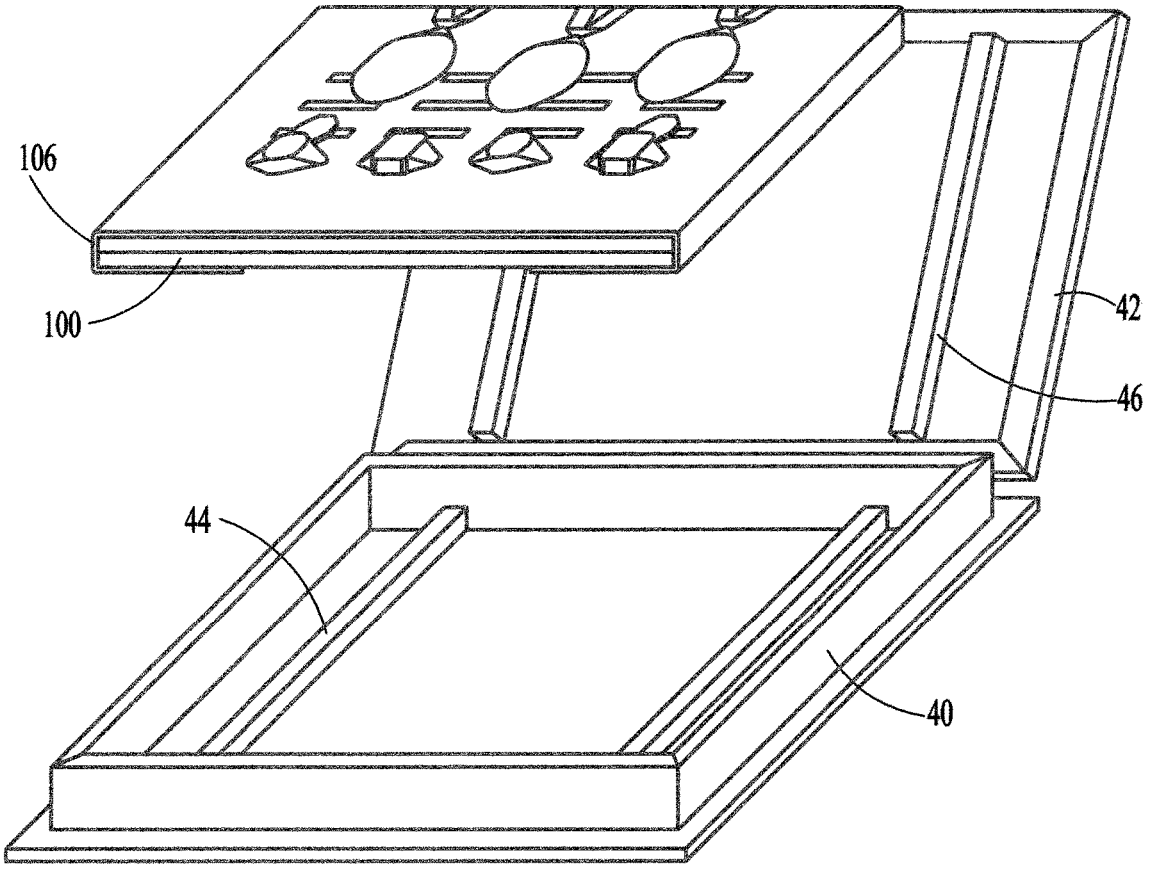
FIG. 16B illustrates the cassette in FIG. 16A and a frame in the sixth preferred embodiment of the present disclosure.
Figure 16C:
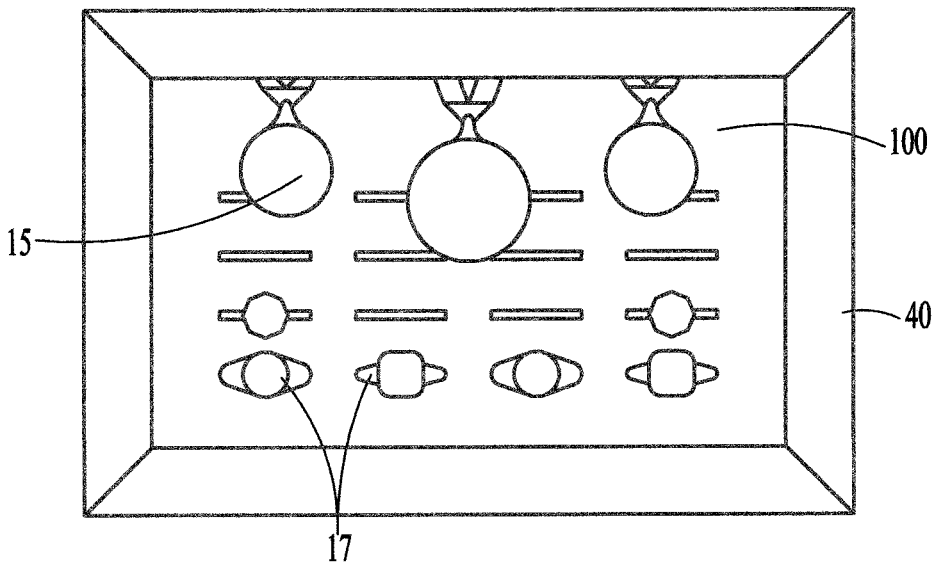
FIG. 16C illustrates a completed display system in the sixth preferred embodiment of the present disclosure.

Next, as shown in FIG. 16B, the completed cassette 100 can be placed into a frame 40. Preferably, spacers 44 are in the bottom of the frame and spacers 46 are attached to a framed glass lid 42. The cassettes rest on the spacers 44. When the lid 42 is closed, spacers 46 and 44 together provide space for displaying the three-dimensional objects and hold the cassettes in the frame. The frame may be hung to display the medals 15 and rings or pins 17, as shown in FIG. 16C.

The medal display and storage system of the present disclosure in all of its embodiments is easy to use. Medals and awards can be added easily and quickly, even by a child without supervision. The display system can be set up on its bottom edge, set flat on its back on a desktop, for example, or hung on a wall. In addition to medals and awards, other three-dimensional items such as a diploma with a tassel, collectible pins, a runner's bib, medal, and photograph, or a military veteran's decorations, for example, can be stored and displayed in the system of the present disclosure.

Although the preferred embodiment of the present disclosure has been illustrated, and that form has been described in detail, it will be readily understood by those skilled in the art that various modifications may be made therein without departing from the spirit of the disclosure or from the scope of the appended claims.

What is claimed is:

1. A do-it-yourself awards storage and display system comprising:

a cassette having a hollow space therein configured to receive ribbons attached to awards within said hollow space; and a cloth cover configured to wrap around said cassette and cover a front surface thereof and configured to display said awards on said cloth cover.

2. The system according to claim 1 wherein said cassette comprises a rectangular case having said front surface and a rear surface in a closed position and having at least one spacer along an inside edge thereof to provide said hollow space as an inside compartment of closed said cassette.

3. The system according to claim 2 wherein said cassette is held closed by said cloth cover wrapped around said front surface of said closed cassette, wherein said cloth cover is fastened to said rear surface of said closed cassette.

4. The system according to claim 3 wherein said cloth cover is fastened by hook and loop tape, hooks, buttons, snaps, or ties.

5. The system according to claim 2 wherein said cassette is held closed by magnets at inside corners of said cassette.

6. The system according to claim 2 wherein said cassette comprises a first half joined to a second half, wherein said first and second halves are configured to be folded against one another to form said closed cassette.

7. The system according to claim 1 wherein said cassette comprises a hollow rectangular box having an open long side and further comprising a foldable pouch having a bracket at each of its ends and configured to receive said ribbons in said hollow space inside said foldable pouch and closed by folding said pouch in half to capture said ribbons between said brackets wherein said pouch is configured to be placed inside said cassette wherein said medals lie on said front surface of said cassette.

8. The system according to claim 1 wherein said cassette comprises a rectangular case having a u-shaped channel at an upper open long end as said hollow space configured to receive said ribbons therein and further comprising a wedge-shaped block configured to be placed into said wedge-shaped block to hold said ribbons in place.

9. The system according to claim 2 further comprising two or more compartments within an interior of said cassette each configured to receive one or more of said ribbons.

10. The system according to claim 2 further comprising spacers along all inside edges of said cassette.

11. The system according to claim 1 further comprising a frame configured to receive one or more of said cassettes within a base thereof and further comprising a lid having a transparent central portion.

12. The system according to claim 11 further comprising at least one spacer on an inside surface of said lid.

13. The system according to claim 12 further comprising at least one spacer on an inside surface of said base.

14. The system according to claim 11 further comprising hinges, locks, latches, or other mechanisms to ensure closure of said frame.

15. The system according to claim 1 further comprising a rectangular tray assembly having a three-sided U-shaped channel and an open fourth side wherein said rectangular tray assembly is configured to receive one or more cassettes slid into said U-shaped channel through said open side.

16. The system according to claim 15 further comprising a frame configured to receive said tray assembly within a base thereof and further comprising a lid having a transparent central portion.

17. The system according to claim 1 further comprising a rectangular tray assembly having a back plate and a shelf perpendicular to said back plate having a lip on said shelf parallel to said back plate, configured to rest a lower edge of said cassette on said shelf and hold said lower edge of said cassette in place with said lip and having metal dots or magnets aligned with magnets at corners of an upper edge of said cassette configured to hold said upper edge of said cassette to said tray assembly.

18. The system according to claim 16 further comprising a frame configured to receive said tray assembly within a base thereof and further comprising a lid having a transparent central portion.

19. The system according to claim 1 further comprising a rectangular support panel having two rows of hooks wherein one half of said cassette includes openings for connecting said cassette to said two rows of hooks.

20. The system according to claim 2 further comprising a plurality of horizontal slots in said front surface of said cassette configured to receive pins or medals without ribbons.

21. A method of using a do-it-yourself awards storage and display system comprising:

providing a cassette having a hollow space therein configured to receive ribbons attached to awards within said hollow space;

placing ribbons within said cassette and closing said cassette; and wrapping a cloth cover around said cassette covering a front surface thereof wherein said awards are displayed on said cloth cover.

22. The method according to claim 21 further comprising:

placing one or more of said cassettes within a base of a frame; and closing a lid having a transparent central portion.

* * * * *